US009117570B2

(12) United States Patent
Park et al.

(10) Patent No.: US 9,117,570 B2
(45) Date of Patent: Aug. 25, 2015

(54) COPPER CLAD ALUMINUM WIRE, COMPRESSED CONDUCTOR AND CABLE INCLUDING THE SAME, AND METHOD OF MANUFACTURING COMPRESSED CONDUCTOR

(71) Applicant: LS Cable & System Ltd., Anyang-si, Gyeonggi-do (KR)

(72) Inventors: Chan Yong Park, Gunpo-si (KR); Chang Eun Cho, Anyang-si (KR)

(73) Assignee: LS CABLE & SYSTEM LTD., Anyang-si, Gyeonggi-do (KR)

( * ) Notice: Subject to any disclaimer, the term of this patent is extended or adjusted under 35 U.S.C. 154(b) by 154 days.

(21) Appl. No.: 13/788,286

(22) Filed: Mar. 7, 2013

(65) Prior Publication Data

US 2013/0233586 A1 Sep. 12, 2013

(30) Foreign Application Priority Data

Mar. 8, 2012 (KR) ..... 10-2012-0023874

(51) Int. Cl.
*H01B 13/00* (2006.01)
*H01B 1/02* (2006.01)
(Continued)

(52) U.S. Cl.
CPC ..... *H01B 13/0036* (2013.01); *H01B 1/023* (2013.01); *H01B 7/0009* (2013.01); *H01B 13/0006* (2013.01); *H01B 13/02* (2013.01); *Y10T 29/49117* (2015.01)

(58) Field of Classification Search
CPC ..... H01B 13/0036; H01B 1/023; H01B 9/02; H01B 1/02; H01B 5/108; D07B 3/10; D07B 5/10; D07B 7/14; B23B 15/20; A47J 36/02; C21D 1/00; C21D 8/00; B21C 23/24; H02G 1/02; H02G 1/14; H02G 7/02; G02B 6/4422
USPC ..... 174/110 R, 128.1; 29/825, 473.9, 479, 29/480, 487; 72/47, 46; 57/9, 6, 13, 15, 57/58.65, 215; 428/652, 607, 931, 925; 228/101; 148/535
See application file for complete search history.

(56) References Cited

U.S. PATENT DOCUMENTS 4,473,995 A * 10/1984 Gentry ..... 57/9
5,223,349 A * 6/1993 Kudo et al. ..... 428/652
(Continued)

FOREIGN PATENT DOCUMENTS

CN 101335118 A * 12/2008 ..... H01B 7/295
CN 202049798 U * 11/2011
(Continued)

OTHER PUBLICATIONS

Fujikura CCA vs Copper Diameter 2007.*
(Continued)

*Primary Examiner* — Timothy Thompson
*Assistant Examiner* — Guillermo Egoavil
(74) *Attorney, Agent, or Firm* — Sherr & Jiang, PLLC

(57) ABSTRACT

Disclosed are a copper clad aluminum wire, a compressed conductor and a cable including the same and a method of manufacturing the compressed conductor. The copper clad aluminum wire, the compressed conductor and a cable including the copper clad aluminum wire and the method of manufacturing the compressed conductor according to embodiments of the present invention may exhibit electrical features similar to those of a conventional pure copper wire without greatly increasing outer diameters of the conductor and the cable, guarantee workability of a worker when the worker installs the cable even in a narrow work space, and efficiently utilize an installation space.

8 Claims, 13 Drawing Sheets

(51) Int. Cl.
*H01B 7/00* (2006.01)
*H01B 13/02* (2006.01)

(56) References Cited

U.S. PATENT DOCUMENTS

| | | | | |
|---|---|---|---|---|
| 2005/0152577 | A1* | 7/2005 | Nishimura et al. | 381/431 |
| 2007/0221706 | A1* | 9/2007 | Calliham | 228/101 |
| 2011/0162763 | A1* | 7/2011 | Calliham, Jr. | 148/535 |

FOREIGN PATENT DOCUMENTS

| | | | | |
|---|---|---|---|---|
| CN | 202049798 U | * | 11/2011 | H01B 9/02 |
| JP | 10295032 A | * | 11/1998 | H02G 7/02 |
| RU | 2441293 C1 | * | 1/2012 | |

OTHER PUBLICATIONS

Power Cables_Conductor Design-Jan. 2003.*

* cited by examiner

COPPER CLAD ALUMINUM WIRE, COMPRESSED CONDUCTOR AND CABLE INCLUDING THE SAME, AND METHOD OF MANUFACTURING COMPRESSED CONDUCTOR

CROSS REFERENCE TO PRIOR APPLICATION

The present application claims priority under 35 U.S.C. §119 to Korean Patent Application No. 10-2012-0023874 (filed on Mar. 8, 2012), which is hereby incorporated by reference in its entirety.

BACKGROUND OF THE INVENTION

1. Field of the Invention

The present invention relates to a copper clad aluminum wire, a compressed conductor and a cable including the same, and a method of manufacturing the compressed conductor, and more specifically, to a copper clad aluminum wire which can exhibit electrical features similar to those of a conventional pure copper wire without greatly increasing an outer diameter, a compressed conductor and a cable including the copper clad aluminum wire, and a method of manufacturing the compressed conductor.

2. Background of the Related Art

As the cost required for purchasing copper, which is an important material of a cable conductor, rises greatly in recent days with the increase of international copper and raw material prices, materials that can substitute for the copper from the aspect of price and performance, while exhibiting electrical features similar to those of copper, are required increasingly.

The biggest problem in developing a substitute material is that it is difficult to secure a material having sufficient reliability in mechanical and physical features so as to be used as a cable conductor, while maintaining electrical features similar to those of copper.

Electrical features, physical features and connector-related features are basis of product design in developing materials of cable conductor, and studies on developing a material satisfying these features and applying existing materials to a cable are under progress.

Particularly, since materials of a conductor generally have a proportional relationship between electrical features and prices of raw materials in many cases, most of substitutable materials have electrical features inferior to those of copper if their prices are low, and if electrical features the substitutable materials are excellent, their prices are high.

Materials used for a cable conductor are generally limited to copper, aluminum, silver or an alloy of these having a high conductivity. The other materials have electrical features considerably inferior to those of the materials described above, and although their electrical features are excellent, prices of raw materials are too high, and thus they are inappropriate to be used as a material of an industrial cable.

The copper which is most frequently used as a cable conductor in the prior art has been used as an important material for a long time owing to high electrical conductivity and low price which are the most optimum conditions as a material of a cable conductor.

However, as the price of copper increases three times or more than ever before due to increase in prices of raw materials, studies on using aluminum or the like of a low price as a conductor material are under progress although its electrical features are inferior to those of copper.

However, if the aluminum is used as a cable conductor, a problem of generation of an oxide film which hinders electrical conductance due to a fast reaction rate, problems occurred by the heat relatively greater than that of copper, and a problem of the cross-section which increases to be larger than that of copper due to the inferior electrical features when it is used as a cable conductor, in addition to the problem of electrical features inferior to those of copper, will be confronted.

Sine an aluminum alloy also has problems similar to those described above, a copper clad aluminum (CCA) wire, which is a wire formed by wrapping a copper strip around an aluminum rod, has been proposed as an alternative to the aluminum alloy.

Since the electrical features of the copper clad aluminum wire are between the features of copper and aluminum, and the problem of generation of an oxide film, which is the most serious problem in applying the aluminum, does not occur, the copper clad aluminum wire is studied as an alternative for substituting the copper as a composite material.

Particularly, according to the specifications of the American Society for Testing Materials (ASTM), the copper clad aluminum wire is standardized to have a copper volume ratio of 10 to 20%, and manufacturing companies mass-produce copper clad aluminum wires having a copper volume ratio of 15 to 20%.

Features of the copper clad aluminum wire, which are degraded compared to those of copper when the copper clad aluminum wire is used as a cable material, are largely divided into electrical conductivity and mechanical features, and the electrical features can be improved according to resistance formulas as the cross-section is increased. That is, since the copper clad aluminum wire has a high wire resistance compared with that of the copper, it should have a diameter considerably larger than that of the copper in order to have a resistance similar to that of the copper.

However, if the outer diameter of the copper clad aluminum wire increases, the outer diameter of the cable also increases. Although the diameter of a conductor is not increased greatly in the case of a solid-type cable such as a conventional coaxial cable applying the copper clad aluminum wire, when the copper clad aluminum wire is applied to a power supply cable of a large diameter, increase of diameter will be a negative factor from the aspect of cable performance.

It is since that if a cable has electrical features the same as those of copper and its weight is relatively light considering specific gravity although its volume is increased compared with that of the copper, a cable having a smaller diameter is advantageous from the aspect of work convenience of a worker who installs the cable and utilization of an installation space.

However, when a cable is manufactured using a conductor which strands existing mass-produced copper clad aluminum wires having a copper volume ratio of 15 to 20%, the diameter of the conductor itself is increased greatly, and the diameter of the cable using the conductor also increases as a result, and thus it is difficult to have an outer diameter similar to that of an existing conductor of a copper material.

Accordingly, it is required to provide a copper clad aluminum wire which can exhibit electrical features similar to those of a conventional pure copper wire without greatly increasing outer diameters of a conductor and a cable.

SUMMARY OF THE INVENTION

Therefore, the present invention has been made in view of the above problems, and it is an object of the present invention to provide a copper clad aluminum wire which can exhibit electrical features similar to those of a conventional pure copper wire without greatly increasing outer diameters of a conductor and a cable.

In addition, since a cable is manufactured to have a small diameter, workability of a worker will be guaranteed when the worker installs the cable even in a narrow work space, and an installation space can be efficiently utilized.

In addition, the overall cost of manufacturing a cable will be lowered through cost cut by reducing the cost of materials to be lower than that of a pure copper wire conductor.

In addition, convenience in transportation and installation will be achieved by reducing the weight of cable to be smaller than that of a pure copper wire conductor.

Objects of the present invention are not limited to the above-described objects and will be obvious from the description, or may be learned by practice of the invention.

In accordance with the present invention, the above and other objects can be accomplished by the provision of a compressed conductor comprising a plurality of copper clad aluminum wires stranded and compressed, wherein the copper clad aluminum wire includes an inner wire made of aluminum or an aluminum alloy and an outer wire made of copper wrapping the inner wire, wherein a volume of the outer wire occupied in the copper clad aluminum wire is 30 to 39%, wherein copper clad aluminum wires in an outermost layer of the compressed conductor have smaller gaps therebetween than copper clad aluminum wires in a central layer thereof.

The copper clad aluminum wires are stranded and then compressed while passing through a compression dice.

An overall outer diameter of the compressed conductor is reduced by compressing the stranded copper clad aluminum wires and a compression rate for reducing the outer diameter is 6 to 8%.

When the copper clad aluminum wires are compressed, outer appearances of the copper clad aluminum wires in the outermost layer configuring the compressed conductor are changed.

When the copper clad aluminum wires are compressed, outer appearances of the copper clad aluminum wires in the outermost layer and in an inner layer adjacent to the outermost layer configuring the compressed conductor are compressed.

In accordance with the present invention, the above and other objects can be accomplished by the provision of a cable comprising a compressed conductor including at least one copper clad aluminum wire and having an outer diameter reduced by compression, an insulation layer for insulating the compressed conductor, and a sheath layer formed outside of the insulation layer to protect the internal configuration, wherein the copper clad aluminum wire includes an inner part made of aluminum or an aluminum alloy and an outer part made of copper occupying 30 to 39% of a volume of the copper clad aluminum wire.

The compressed conductor comprises a plurality of copper clad aluminum wires stranded to form a layer in a radius direction.

Copper clad aluminum wires in an outermost layer of the compressed conductor have smaller gaps therebetween than copper clad aluminum wires in a central layer thereof.

Copper clad aluminum wires in an outermost layer configuring the compressed conductor or copper clad aluminum wires in the outermost layer and in an inner layer adjacent to the outermost layer have outer appearances different from copper clad aluminum wires in a central layer of the compressed conductor.

The compressed conductor has an outer diameter that is 1.09 to 1.12 times larger than an outer diameter of a conductor including a same number of copper wires as the cooper clad aluminum wires.

In accordance with the present invention, the above and other objects can be accomplished by the provision of a method of manufacturing a compressed conductor, the method comprising the steps of wrapping a copper strip around an outer periphery of an aluminum wire or an aluminum alloy wire and welding the copper strip, drawing a copper clad aluminum wire having a copper volume of 30 to 39%, stranding the drawn copper clad aluminum wires and reducing an overall diameter by compressing the stranded copper clad aluminum wires by passing the stranded copper clad aluminum wires through a compression dice.

The method further comprises the step of cooling down heat generated when the copper strip is welded.

The method further comprises the step of treating the compressed conductor by heating to improve flexibility of the compressed conductor.

The step of reducing an overall diameter compresses and deforms copper clad aluminum wires in an outermost layer.

A compression rate of the compression dice is 6 to 8%.

DESCRIPTION OF SYMBOLS

Figure 1:
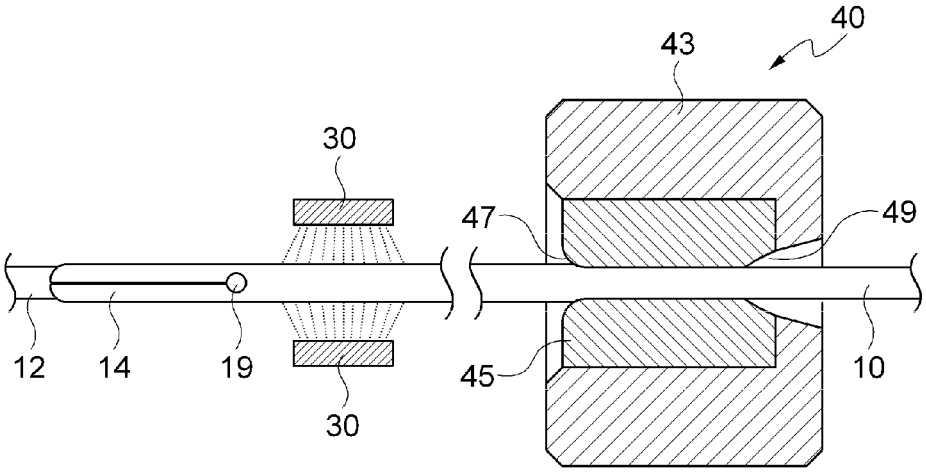
FIG. 1 is a view showing a process of manufacturing a copper clad aluminum wire according to an embodiment of the present invention.

| | |
|---|---|
| 10: Copper clad aluminum wire | 12: Inner wire |
| 14: Outer wire | 20: Compressed conductor |
| 100, 200: Cable | |

DETAILED DESCRIPTION OF THE PREFERRED EMBODIMENT

Preferred embodiments of the present invention will be described below in more detail with reference to the accompanying drawings. Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

Figure 2:
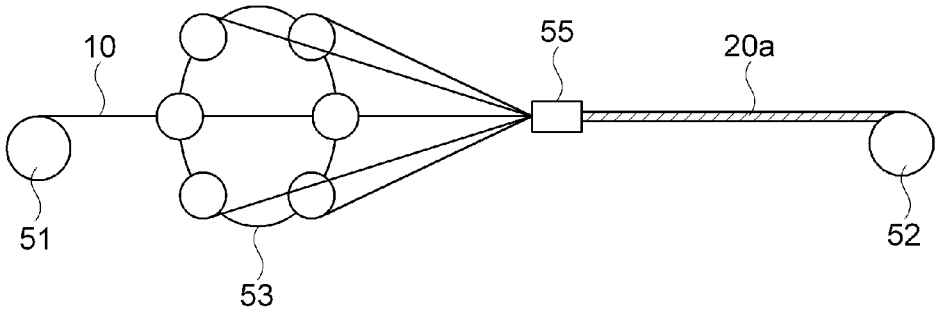
FIG. 2 is a view showing a process of manufacturing a conductor by stranding copper clad aluminum wires according to an embodiment of the present invention.
Figure 3:
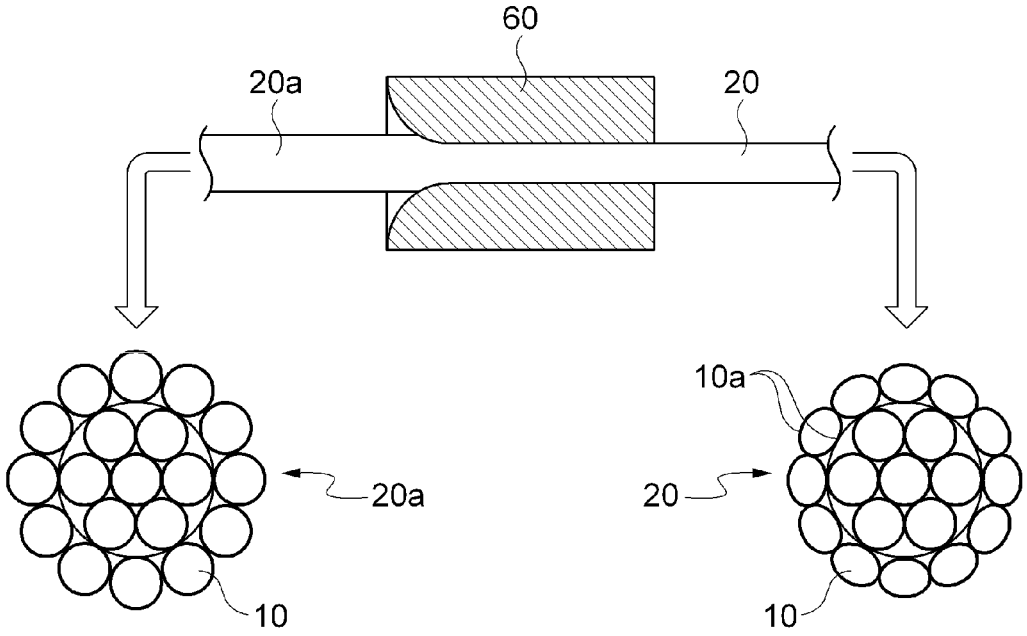
FIG. 3 is a view showing a process of compressing a conductor according to an embodiment of the present invention.
Figure 4:
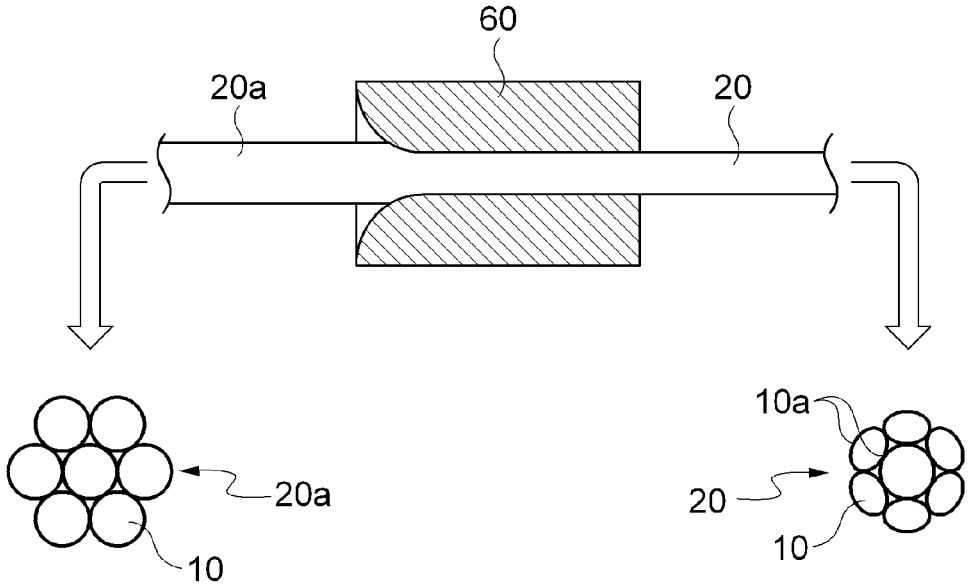
FIG. 4 is a view showing a process of compressing a conductor according to another embodiment of the present invention.
Figure 5:
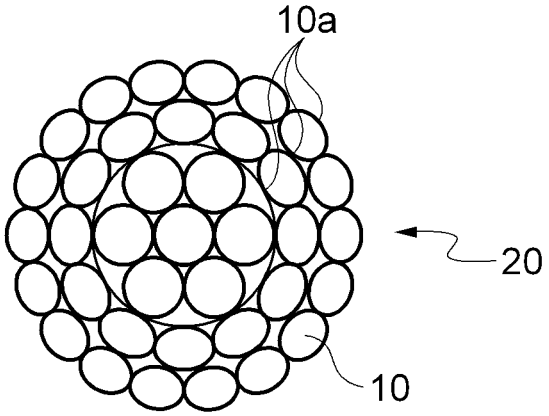
FIG. 5 is a cross-sectional view showing a compressed conductor according to still another embodiment of the present invention.
Figure 6:
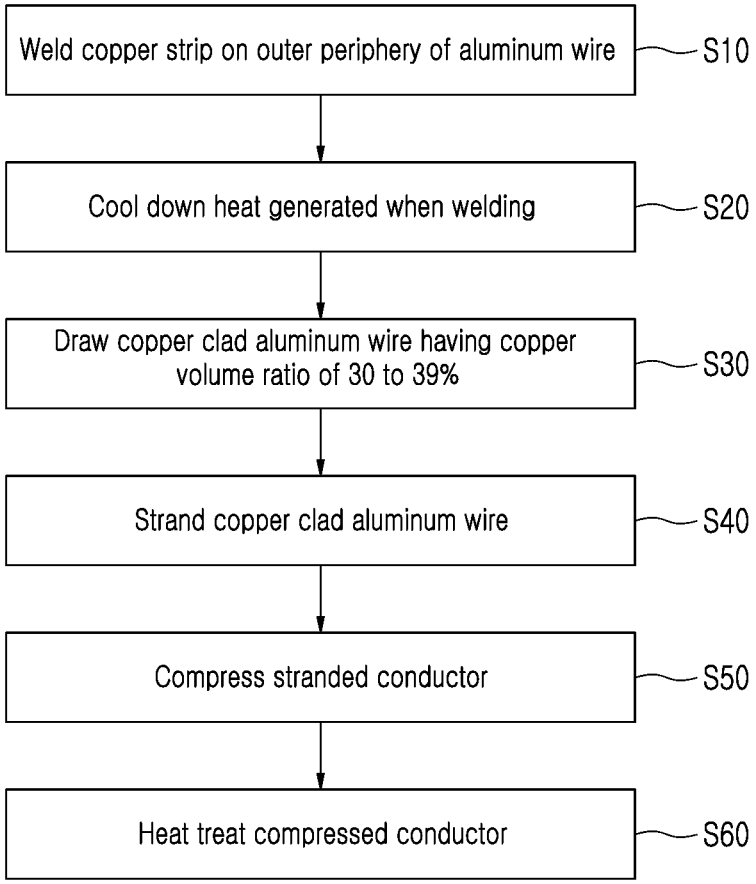
FIG. 6 is a flowchart showing a process of manufacturing a compressed conductor according to an embodiment of the present invention.

FIG. 1 is a view showing a process of manufacturing a copper clad aluminum wire according to an embodiment of the present invention, FIG. 2 is a view showing a process of manufacturing a conductor by stranding copper clad aluminum wires according to an embodiment of the present invention, and FIG. 3 is a view showing a process of compressing a conductor according to an embodiment of the present invention. FIG. 4 is a view showing a process of compressing a conductor according to another embodiment of the present invention, FIG. 5 is a cross-sectional view showing a compressed conductor according to still another embodiment of the present invention, and FIG. 6 is a flowchart showing a process of manufacturing a compressed conductor according to an embodiment of the present invention.

Referring to FIGS. 1 to 6, in a compressed conductor manufactured by stranding copper clad aluminum wires 10 according to an embodiment of the present invention, the copper clad aluminum wire 10 includes an inner wire 12 made of aluminum or an aluminum alloy and an outer wire 14 made of copper wrapping the inner wire 12. The volume of the outer wire 14 occupies 30 to 39% of the copper clad aluminum wire 10, and the overall diameter of a conductor is reduced by compressing the stranded copper clad aluminum wires 10.

The copper clad aluminum wire 10 may have an inner part made of aluminum or an aluminum alloy and an outer part made of copper occupying 30 to 39% of the volume of copper clad aluminum wire. As shown in FIG. 1, the copper clad aluminum wire 10 is manufactured by wrapping the outer periphery of the inner wire 12 made of aluminum or an aluminum alloy with the outer wire 14 made of copper and welding the outer wire 14.

Here, the inner wire 12 can be made of pure aluminum or an aluminum alloy, and the aluminum alloy may contain a composition element, such as Al (aluminum), Fe (iron), Cu (copper), Mg (magnesium), Si (silicon), or Zn (zinc), and other impurities.

Describing the process of manufacturing the inner wire of an aluminum alloy, first, an alloy material is prepared using Al (aluminum), Fe (iron), Cu (copper), Mg (magnesium), Si (silicon), or Zn (zinc) as a composition element, and the inner wire 12 is completed by performing heat treatment after drawing the alloy material in a cold state to have a desired shape and outer diameter.

Meanwhile, thickness of the outer wire 14 made of copper, i.e., a copper strip wrapping the inner wire 12 of the copper clad aluminum wire 10 according to an embodiment of the present invention, can be adjusted to occupy 30 to 39% of the overall volume of the copper clad aluminum wire 10.

Describing the process of manufacturing the copper clad aluminum wire 10 in further detail, first, the outer wire 14 of a copper strip wraps the inner wire 12 made of aluminum or an aluminum alloy, and the outer wire 14 is welded using a welder 19 S10.

Then, a cooling device 30 cools down the heat generated when the outer wire 14 is welded using the welder 19 S20. This is to prevent increase of the possibility of generating and peeling an interfacial reaction layer vulnerable to corrosion, which is anticipated when the temperature at the contacting portions of the copper and the aluminum rises due to the welding. An apparatus injecting an inert gas of a low temperature can be used as the cooling device 30.

Then, the copper clad aluminum wire 10 having a copper volume of 30 to 39% is drawn when the inner and outer wires pass through a wire drawing dice 40 S30, and a copper clad aluminum wire 10 of a desired shape and diameter can be obtained through the wire drawing process.

At this point, the wire drawing dice 40 is provided with a dice case 43 of a cylindrical shape, and a dice tip 45 formed as a through hole slanted from a wire entry 47 to a wire exit 49 can be fixedly installed inside the dice case 43.

If a wire of a large diameter is inserted into the wire entry 47 of the dice tip 45 structured as described above, a wire of a further smaller diameter comes out through the wire exit 49, and accordingly, the copper clad aluminum wire 10 having a desired shape and diameter can be drawn, and the binding force between the inner wire 12 and the outer wire 14 can be enhanced.

The copper clad aluminum wire 10 manufactured as described above passes through a stranding process as shown in FIG. 2 S40. Here, a plurality of copper clad aluminum wires 10 passes through a cage 53 starting from a payoff bobbin 51 to be converged and stranded at a point through a stranding dice 55, and the copper clad aluminum wires 10 configure a layer in the radius direction through this process.

At this point, the copper clad aluminum wires 10 are stranded while being twisted to have a predetermined pitch and form a stranded conductor 20*a*, and the stranded conductor 20*a* is collected as it is wound around a take-up bobbin 52.

The stranded conductor 20*a* is compressed when it passes through a compression dice 60 as shown in FIGS. 3 and 4, and the compressed conductor 20 including the copper clad aluminum wires 10 according to an embodiment of the present invention is manufactured through this process S50. At this point, the conductor has the same cross-section before and after the compression, and the outer diameter of the compressed conductor 20 is reduced by deforming the copper clad aluminum wires 10 in the outermost layer and reducing the gaps between the deformed copper clad aluminum wires 10.

That is, as shown in FIGS. 3 and 4, the copper clad aluminum wires 10 in the outermost layer have a compression surface 10*a* where the outer appearance of the outer periphery is changed. Although it is preferable to manufacture the compressed conductor 20 by compressing and deforming only the outermost layer in this manner, in the case of a conductor 20*a* stranding a large number of copper clad aluminum wires 10 as shown in FIG. 5, even an inner layer adjacent to the outermost layer, as well as the outermost layer, can be compressed in order to obtain a desired outer diameter, and in this case, the copper clad aluminum wires 10 of the inner layer also have a compression surface 10*a* where the outer appearance of the outer periphery is changed.

Then, after the compressed conductor 20 is completed, a heat treatment process can be additionally performed on the compressed conductor 20 in order to improve flexibility of the compressed conductor 20 S60.

Through the processes described above, the compressed conductor 20 including the copper clad aluminum wires 10 having a copper volume ratio of 30 to 39% is completed.

Although the existing mass-produced copper clad aluminum wires having a copper volume ratio of 15 to 20% are compressed, it is difficult to obtain an outer diameter similar to that of a copper conductor. In order to solve this problem, in an embodiment of the present invention, the copper clad aluminum wires are produced by adjusting the volume ratio of copper occupied in the copper clad aluminum wire to 30 to 39%.

In relation to the volume ratio, since the outer diameter of the copper clad aluminum wire 10 increases greatly if the volume ratio of the copper is less than 30%, an excessive compression rate should be applied to the stranded conductor in order to obtain a desirable outer diameter.

In this case, when the conductor is compressed, the shape of the wire is deformed, and a work hardening phenomenon occurs, and thus flexibility of the conductor is lowered since rigidity of the wire is increased as the work hardening is increased. That is, when the copper volume ratio is less than 30%, it is difficult to obtain an outer diameter similar to that of copper by applying an appropriate level of compression within a range that does not lower the flexibility of the conductor.

On the other hand, when the copper volume ratio exceeds 39%, the heat input needed for welding the copper strip for tubing the copper clad aluminum is excessively increased, and the welding is improperly finished, and in addition, although a cooling facility is equipped, it is difficult to continuously and stably manufacture the cable since the welder and the production facilities are overburdened.

Accordingly, a compressed conductor 20 having excellent electrical and mechanical features and a desirable diameter and productivity can be manufactured by only using the aforementioned copper clad aluminum wire 10 having a copper volume ratio of 30 to 39%.

Meanwhile, the compressed conductor 20 manufactured as described above can be used as a conductor for a power, control, signal, communication or sensor cable, and an embodiment of the compressed conductor 20 used for signaling is described below with reference to FIG. 3.

First, in order manufacture a compressed conductor 20 for signaling, 2.50 mm copper clad aluminum wires 10 having a copper volume ratio of 30% are prepared, and a stranded conductor 20*a* of 70SQMM based on copper is prepared by stranding the copper clad aluminum wires 10.

In the stranding process, a stranded conductor 20*a* including total 19 strands is manufactured by stranding 6 strands around a core wire in the first stage and stranding 12 strands in the outermost layer in the second stage, and the stranded conductor 20*a* is compressed by the compression dice 60. At this point, a strand pitch of an existing copper wire may be considered as a strand pitch of the stranded conductor 20*a*.

The diameter of the stranded conductor 20*a* manufactured using the 2.50 mm copper clad aluminum wires 10 having a copper volume ratio of 30% is 12.50 mm before compression, and the diameter of a 70SQMM conductor made of a copper wire having the same resistance is about 10.70 mm.

However, if the stranded conductor 20*a* passes through the compression dice 60 having a diameter of 10.50 mm, a compressed conductor 20 having an outer diameter reduced to about 10.60 to 10.80 mm from 12.50 mm can be manufactured while maintaining the cross-section of the stranded conductor 20*a* as is, considering elastic deformation values of the material.

Meanwhile, another embodiment of the compressed conductor 20 used for signaling is described below with reference to FIG. 4.

First, in order manufacture a compressed conductor 20 for signaling, 0.92 mm copper clad aluminum wires 10 having a copper volume ratio of 30% is manufactured, and a stranded conductor 20*a* of 4SQMM based on copper is prepared by stranding the copper clad aluminum wires 10.

In the stranding process, a stranded conductor 20*a* including total 7 strands is manufactured by stranding 6 strands around a core wire, and the stranded conductor 20*a* is compressed by the compression dice 60.

The diameter of the stranded conductor 20*a* manufactured using the 0.92 mm copper clad aluminum wires 10 having a copper volume ratio of 30% is 2.76 mm before compression, and the diameter of a 4SQMM conductor made of a copper wire having the same resistance is about 2.55 mm.

However, if the stranded conductor 20*a* passes through the compression dice 60 having a diameter of 2.50 mm, a compressed conductor 20 having an outer diameter reduced to about 2.50 to 2.55 mm from 2.76 mm can be manufactured while maintaining the cross-section of the stranded conductor 20*a* as is, considering elastic deformation values of the material.

Figure 7:
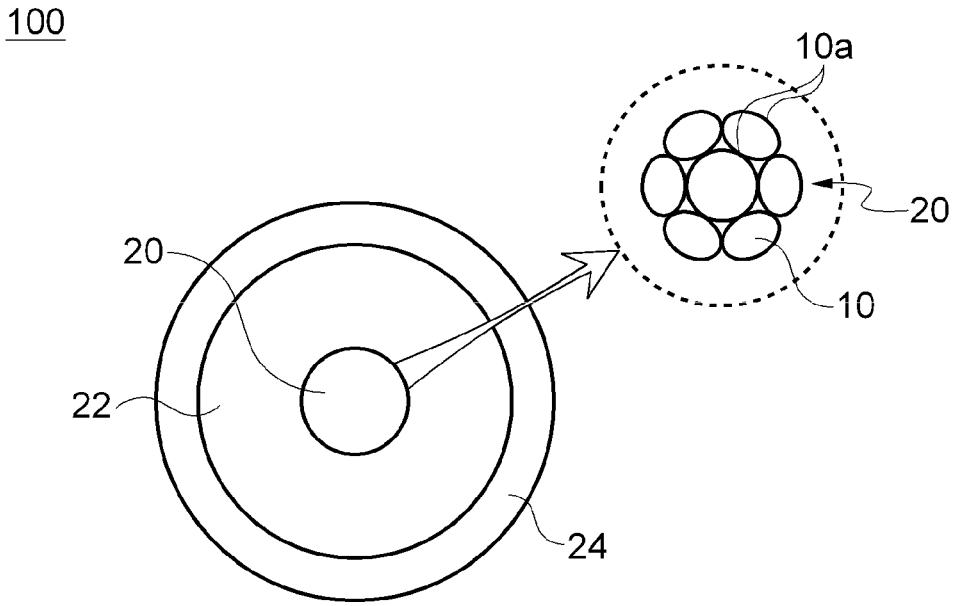
FIG. 7 is a cross-sectional view showing a cable according to an embodiment of the present invention.
Figure 8:
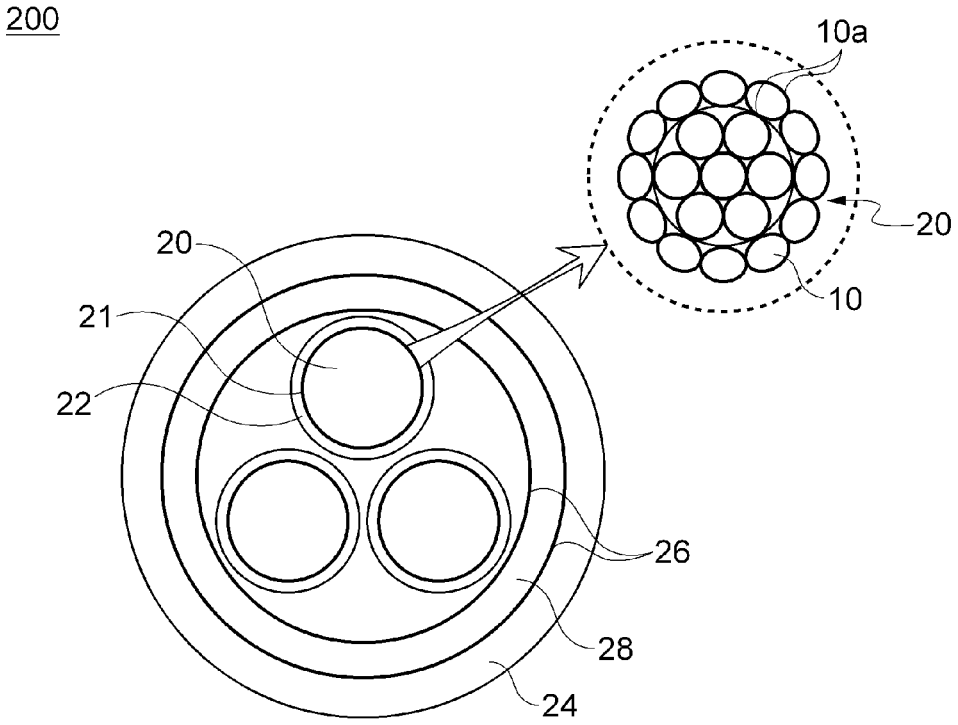
FIG. 8 is a cross-sectional view showing a cable according to another embodiment of the present invention.

FIG. 7 is a cross-sectional view showing a cable according to an embodiment of the present invention, and FIG. 8 is a cross-sectional view showing a cable according to another embodiment of the present invention.

Referring to FIGS. 7 and 8, a cable 100 or 200 including a copper clad aluminum wire 10 according to an embodiment of the present invention largely comprises the copper clad aluminum wire 10 including an inner part made of aluminum or an aluminum alloy and an outer part made of copper occupying 30 to 39% of the volume of copper clad aluminum wire, a compressed conductor 20 including at least one copper clad aluminum wire 10 and having an outer diameter reduced by compression, an insulation layer 22 for insulating the compressed conductor 20, and a sheath layer 24 formed outside of the insulation layer to protect the internal configuration.

The cable 100 shown in FIG. 7 relates to a communication cable having a configuration of a general coaxial cable, in which the compressed conductor 20 is used as a core conductor at the center of the cable, the insulation layer 22 wraps outside of the compressed conductor 20, and the sheath layer 24 wraps outside of the insulation layer 22.

The insulation layer 22 is formed of a material having features of insulation and impact resistance and covers the compressed conductor 20 to protect and insulate the compressed conductor 20. Here, the insulation layer 22 may be made of silicone, cross-linked polyethylene (XLPE), cross-linked polyolefin (XLPO), ethylene-propylene rubber (EPR), polyvinyl chloride (PVC) or a mixture of these.

The sheath layer 24 is provided at the outermost side of the cable 100 and protects the cable 100 from external impacts or corrosion actions. The sheath layer 24 may be made of polyvinyl chloride (PVC), polychloroprene rubber (CR), chloro sulfonated polyethylene (CSPE), chlorinated polyethylene (CPE), ethylene vinyl acetate (EVA) or a mixture of these, which are halogen free materials having a high impact resistance.

Here, although the compressed conductor 20 is formed in the structure of the compressed conductor 20 described in FIG. 3, it is not limited thereto. Apparently, the compressed conductor 20 is manufactured by stranding and compressing the copper clad aluminum wire 10 including an inner part made of aluminum or an aluminum alloy and an outer part made of copper occupying 30 to 39% of the volume of copper clad aluminum wire, as is described above.

Meanwhile, the cable 200 shown in FIG. 8 is an example of a vessel/marine cable, in which an assembly of three of the aforementioned compressed conductor 20 is used as a core conductor at the center of the cable. Each of the compressed conductors 20 is wrapped with a first binding tape 21, and outside of the first binding tape is insulated by an insulation layer 22.

In addition, a bedding layer 28 and a sheath layer 24 are provided outside of the compressed conductor 20 assembly. A second binding tape 26 wraps inside of the bedding layer 28, and the second binding tape 26 wraps the bedding layer 28 between the bedding layer 28 and the sheath layer 24.

The bedding layer 28 protects the compressed conductor 20 inside thereof by absorbing external impacts. Like the sheath layer 24, the bedding layer 28 may be made of polyvinyl chloride (PVC), polychloroprene rubber (CR), chloro sulfonated polyethylene (CSPE), chlorinated polyethylene (CPE), ethylene vinyl acetate (EVA) or a mixture these, which are halogen free materials having a relatively high impact resistance among polymer materials.

Here, although the compressed conductor 20 is formed in the structure of the compressed conductor 20 described in FIG. 4, it is not limited thereto. Apparently, the compressed conductor 20 is manufactured by stranding and compressing the copper clad aluminum wire 10 including an inner part made of aluminum or an aluminum alloy and an outer part made of copper occupying 30 to 39% of the volume of copper clad aluminum wire, as is described above.

As described above, the copper clad aluminum wire 10 and the cables 100 and 200 manufactured using the compressed conductor 20 including the copper clad aluminum wire 10 are advantageous in that since the cables are manufactured to have a small diameter, workability of a worker is guaranteed when the worker installs the cable even in a narrow work space, and an installation space can be efficiently utilized.

Figure 9:
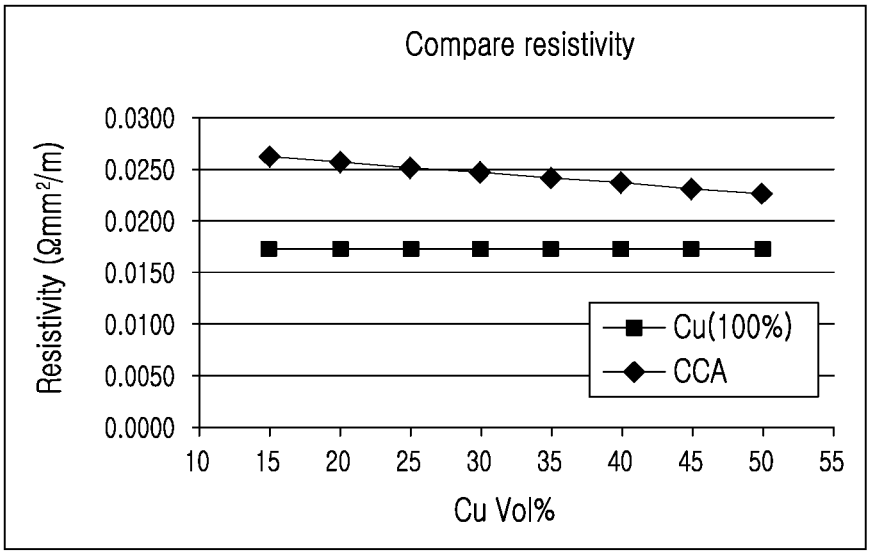
FIG. 9 is a graph comparing resistivity of a copper clad aluminum wire with that of a copper wire according to an embodiment of the present invention.
Figure 10:
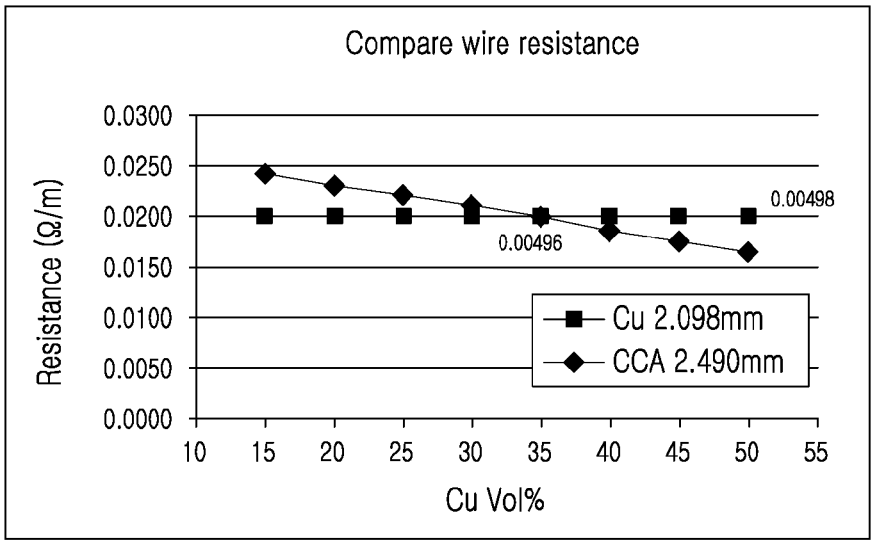
FIG. 10 is a graph comparing wire resistance of a copper clad aluminum wire with that of a copper wire according to an embodiment of the present invention.
Figure 11:
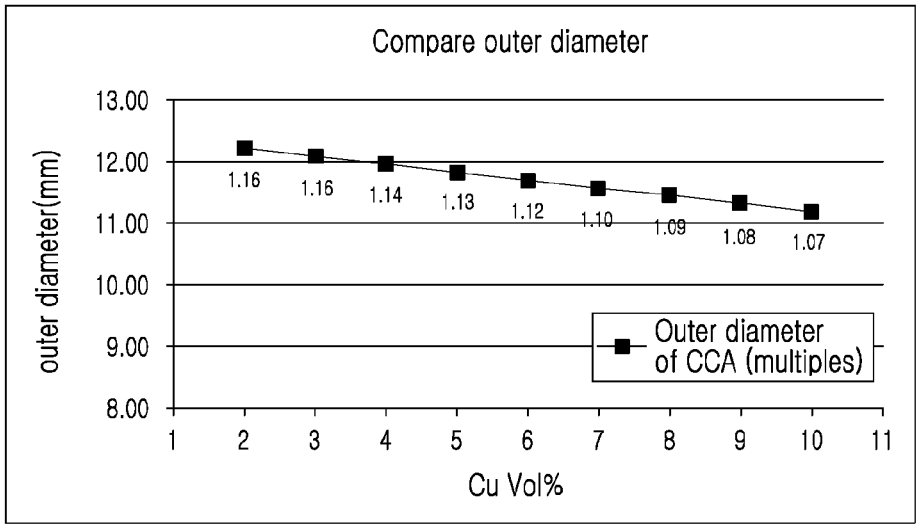
FIG. 11 is a graph showing a ratio of an outer diameter of a compressed conductor made of a copper clad aluminum wire to an outer diameter of a conductor made of a copper wire according to an embodiment of the present invention.
Figure 12:
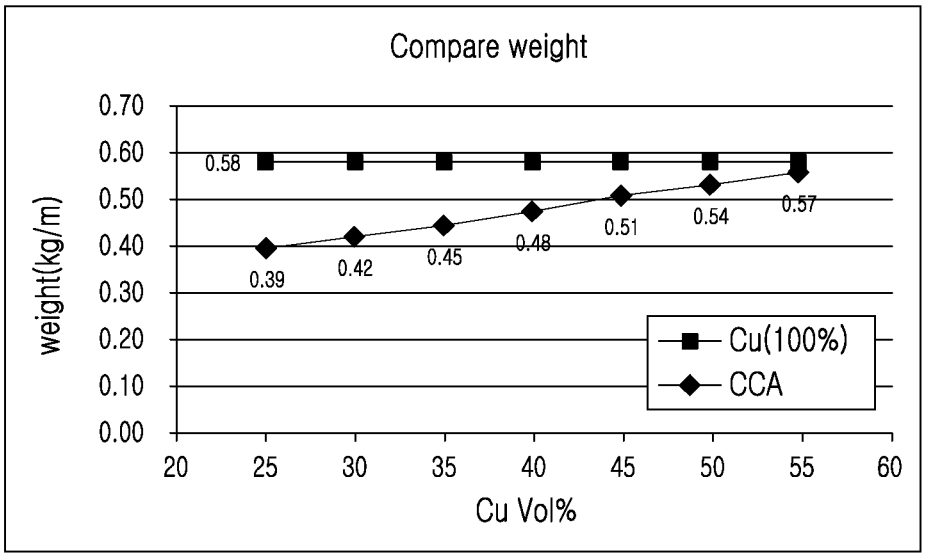
FIG. 12 is a graph comparing weight of a compressed conductor made of a copper clad aluminum wire with that of a conductor made of a copper wire according to an embodiment of the present invention.
Figure 13:
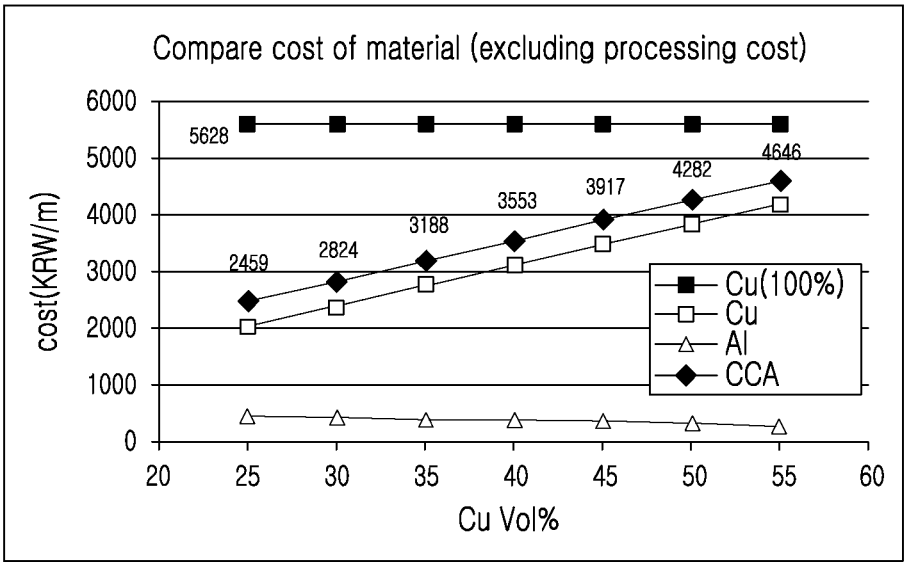
FIG. 13 is a graph comparing the cost of material of a compressed conductor made of a copper clad aluminum wire with that of a conductor made of a copper wire, excluding the processing cost, according to an embodiment of the present invention.
Figure 14:
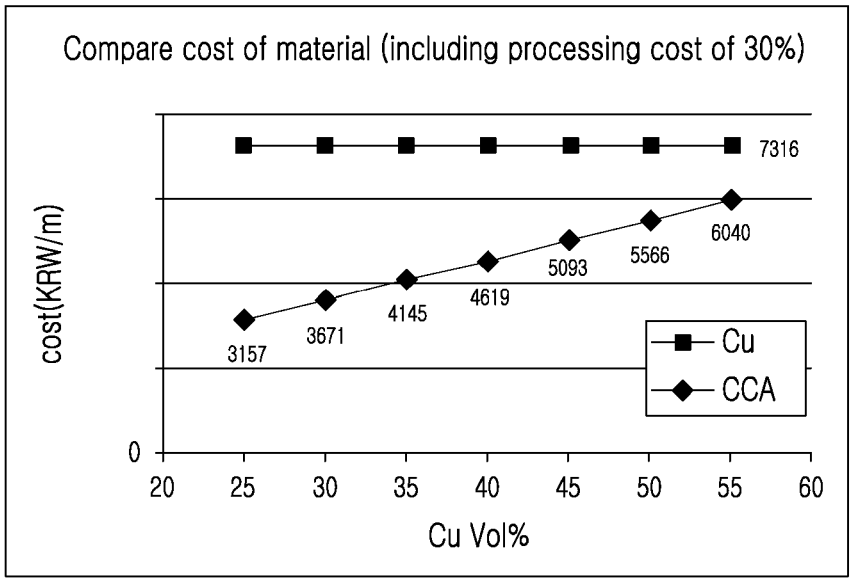
FIG. 14 is a graph comparing the cost of material of a compressed conductor made of a copper clad aluminum wire with that of a conductor made of a copper wire, including the processing cost, according to an embodiment of the present invention.

FIG. 9 is a graph comparing resistivity of a copper clad aluminum wire with that of a copper wire according to an embodiment of the present invention, FIG. 10 is a graph comparing wire resistance of a copper clad aluminum wire with that of a copper wire according to an embodiment of the present invention, and FIG. 11 is a graph showing a ratio of an outer diameter of a compressed conductor made of a copper clad aluminum wire to an outer diameter of a conductor made of a copper wire according to an embodiment of the present invention. FIG. 12 is a graph comparing weight of a compressed conductor made of a copper clad aluminum wire with that of a conductor made of a copper wire according to an embodiment of the present invention, FIG. 13 is a graph comparing the cost of material of a compressed conductor made of a copper clad aluminum wire with that of a conductor made of a copper wire, excluding the processing cost, according to an embodiment of the present invention, and FIG. 14 is a graph comparing the cost of material of a compressed conductor made of a copper clad aluminum wire with that of a conductor made of a copper wire, including the processing cost, according to an embodiment of the present invention.

The features of copper clad aluminum wire and the compressed conductor according to an embodiment of the present invention will be described below with reference to FIGS. 9 to 14.

Comparing resistivity (Ωmm2/m) of a copper wire with resistivity of a copper clad aluminum wire, a result of the comparison is as shown in the graph of FIG. 9. It is understood that although resistivity of the copper clad aluminum wire varies according to the volume ratio of copper (Cu Vol %), the copper clad aluminum wire has a high resistivity value compared with the copper.

Therefore, a wire thicker than the copper wire should be used, and comparing wire resistance of a copper clad aluminum wire having a diameter of 2.490 mm with wire resistance of a copper wire having a diameter of 2.098 mm according to a copper volume ratio (Cu Vol %), a result of the comparison is as shown in the graph of FIG. 10.

The copper clad aluminum wire has a wire resistance similar to that of 100% copper within a range of a copper volume ratio (Cu Vol %) of 30 to 39%, and particularly, the wire resistance is further lowered to 0.00468 Ω/m when the copper volume ratio (Cu Vol %) is 35%.

Since the copper clad aluminum wire has a resistivity higher than that of copper, the outer diameter of a wire should be relatively large so that the copper clad aluminum wire may have a conductor resistance similar to that of copper. However, increase of the outer diameter can be avoided through the compressed conductor according to embodiments of the present invention, and thus the outer diameter of the cable can be reduced to a level similar to that of a case using a copper wire.

Meanwhile, when 19 strands of a copper clad aluminum wire (Cu 35%) having a diameter of 2.490 mm are stranded and compressed, diameters of a conductor made of a copper wire with respect to respective compression rates are shown in the graph of FIG. 11 in the form of multiples.

The outer diameter of a conductor manufactured by stranding copper wires having a diameter of 2.098 mm is about 10.49 mm, and the outer diameter of a conductor manufactured by stranding copper clad aluminum wires having a diameter of 2.490 mm is about 12.45 mm. The outer diameter of the conductor is reduced to about 11.58 mm, which is about 1.1 times larger than the outer diameter of the conductor of a copper wire, through compression of about 7%.

The compressed conductor according to an embodiment of the present invention may obtain an outer diameter (about 1.09 to 1.12 times) similar to that of copper by applying a compression rate of around 7% (about 6 to 8%), and since an excessive compression rate is not applied, excellent mechanical features can be exhibited.

Describing in further detail, when a conductor manufactured by stranding copper clad aluminum wires having a copper volume ratio of 30 to 39% is compressed with a compression rate of 6 to 8%, the conductor has an outer diameter similar to that of a copper conductor having an equal resistance.

Since reduction of the outer diameter is insufficient when the compression rate is less than 6%, workability is lowered when the cable is installed, and the outer diameter of the conductor is increased. Therefore, since consumption of materials other than the conductor also increases, there is a problem from the aspect of manufacturing cost.

Contrarily, when the compression rate exceeds 8%, it is difficult to stably accomplish a compression rate in a compression method of a compressed type, in which compression is applied only to the outermost layer or only to the outermost layer and an immediate inner layer with a small compression power.

Accordingly, a compression method of a compact type should be applied, in which a further larger compression power is applied, or compression is applied to each layer of the conductor. However, the compression method of the compact type has a high disconnection rate in the process of stranding compared with the compressed type, and since flexibility of the conductor is lowered after compression, flexibility of the cable is also lowered, and thus workability is lowered when the cable is installed as it does when the compression rate is less than 6%.

Meanwhile, in relation to a ratio of the outer diameter of the conductor made of a copper wire to the outer diameter of the compressed conductor made of a copper clad aluminum wire, the compressed conductor of a copper clad aluminum wire having an outer diameter that is 1.09 to 1.12 times larger than the outer diameter of the conductor made of a copper wire of the same class reduces the manufacturing cost to a level of 50 to 63% while having a resistance similar to that of copper, and its weight is reduced to a level of 72 to 83%, and thus workability is improved.

At this point, as the copper clad aluminum conductor is compressed, its flexibility is lowered to a level of about 95% compared with the copper conductor. However, this is within a range that does not lower the workability.

In practice, comparing weight per meter of a compressed conductor including a copper clad aluminum wire of an equal resistance level (based on 70SQMM of a copper wire) with that of a copper conductor with respect to the copper volume ratio, it is confirmed as shown in the graph of FIG. 12 that the weight of the compressed conductor is reduced to a level of about 72 to 83% of the weight of the copper conductor within a range of 30 to 39% of the copper volume ratio of the copper clad aluminum wire and reduced to a level of about 73 to 78% of the weight of the copper conductor within a range of 33 to 35% of the copper volume ratio of the copper clad aluminum wire.

That is, the compressed conductor including the copper clad aluminum wire according to the present invention accomplishes a considerable result in number from the aspect of lightweightness.

In addition, the compressed conductor including the copper clad aluminum wire according to the present invention is advantageous from the aspect of manufacturing cost as shown in FIGS. 13 and 14, and price per meter of a copper clad aluminum wire of an equal resistance level is compared with that of a copper conductor with respect to the copper volume ratio (based on 70SQMM of a copper wire).

Here, the price of copper is 8,569 US$/ton, and the price of aluminum is 2,262 US$/ton. The exchange rate of 1124.7 KRW per US$ as of Jan. 30, 2012 is applied.

As is shown in the graphs, the manufacturing cost including material cost and processing cost is about 50 to 63% of the price of 100% copper when the copper volume ratio of the copper clad aluminum wire is within a range of 30 to 39% and about 53 to 57% of the price of 100% copper when the copper volume ratio of the copper clad aluminum wire is within a range of 33 to 35%, and thus it is confirmed that a great effect of cost saving is obtained.

That is, it is confirmed that manufacturing cost of a conductor is considerably lowered compared with that of existing conductors.

As described above, in manufacturing a compressed conductor 20 including a copper clad aluminum wire 10, electrical features, heat generated by current flow, peeling at the interface of different materials, disconnection in the stranding process, flexibility of a cable as a finished product and the like should be considered in order to compress the conductor to a level similar to the copper.

When a cable is compressed applying the numbers specified in the ASTM specification at a copper volume ratio of to 20% of a mass-produced existing product, a considerably high compression rate should be applied, and thus it is difficult to satisfy both the electrical and mechanical features, and an outer diameter of a desired level cannot be obtained although it is compressed.

In addition, as a result of experiments performed by increasing the copper volume ratio within a range capable of producing a cable, if copper is used 40% or more from a technical viewpoint, the heat input needed for welding the copper strip is excessively increased, and the welding is improperly finished, and, in addition, although a cooling device is used, it is difficult to continuously manufacture the cable since the welder and the production facilities are overburdened.

As a result of experiments for identifying an optimum copper volume ratio for obtaining a desired resistance without negatively affecting production of the cable, it is confirmed as described above that electrical features of a compressed conductor manufactured using a copper clad aluminum wire having a copper volume ratio of 30 to 39%, further preferably 33 to 35%, converge to an appropriate resistance value.

Here, the compression rate is applied only as high as to reduce the outer diameter of the conductor to a level desired by a manufacturer by deforming and compressing the wires in the outermost layer, and the problem of disconnection caused by relatively inferior mechanical features obtained when an excessively high compression rate is applied in the stranding process and the problem of low workability in handling and installing a finished cable product, which is caused by degradation of flexibility of a completed conductor, are solved.

As shown in the embodiments of the present invention, since the compression rate is applied only as high as to compress only the outermost layer or the outermost layer and an immediate inner layer, a cable can be compressed without severely damaging the copper clad aluminum wire, and since degradation of flexibility of the cable is as low as to be ignorable, the copper clad aluminum wire is appropriate to be used as a conductor of a cable.

Accordingly, a compressed conductor including a copper clad aluminum wire according to an embodiment of the present invention may have a resistance value similar to that of copper and solve the problems such as increase of outer diameter, peeling, disconnection, degradation of flexibility of a finished product and the like that a conductor manufactured using an existing copper clad aluminum wire has.

In the embodiments of the present invention, electrical features similar to those of a conventional pure copper wire can be exhibited without greatly increasing outer diameters of a conductor and a cable.

In addition, since a cable is manufactured to have a small diameter, workability of a worker is guaranteed when the worker installs the cable even in a narrow work space, and an installation space can be efficiently utilized.

In addition, the overall cost of manufacturing a cable can be lowered through cost cut by reducing the cost of materials to be lower than that of a pure copper wire conductor.

In addition, convenience in transportation and installation can be achieved by reducing the weight of cable to be smaller than that of a pure copper wire conductor.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A compressed conductor comprising:

a plurality of copper clad aluminum wires stranded and compressed, wherein the copper clad aluminum wire includes:

an inner wire made of aluminum or an aluminum alloy; and an outer wire made of copper wrapping the inner wire, wherein a volume of the outer wire occupied in the copper clad aluminum wire is 30 to 39%, wherein copper clad aluminum wires in an outermost layer of the compressed conductor have smaller gaps therebetween than copper clad aluminum wires in a central layer thereof, wherein the compressed conductor has an outer diameter that is 1.09 to 1.12 times larger than an outer diameter of a conductor including a same number of copper wires as the cooper clad aluminum wires.

2. The compressed conductor according to claim 1, wherein the copper clad aluminum wires are stranded and then compressed while passing through a compression dice.

3. The compressed conductor according to claim 1, wherein an overall outer diameter of the compressed conductor is reduced by compressing the stranded copper clad aluminum wires and a compression rate for reducing the outer diameter is 6 to 8%.

4. The compressed conductor according to claim 1, wherein when the copper clad aluminum wires are compressed, the copper clad aluminum wires in the outermost layer configuring the compressed conductor are compressed.

5. The compressed conductor according to claim 1, wherein when the copper clad aluminum wires are compressed, the copper clad aluminum wires in the outermost layer and an inner layer adjacent to the outermost layer configuring the compressed conductor are compressed.

6. A cable comprising:

a compressed conductor including at least one copper clad aluminum wire and having an outer diameter reduced by compression, an insulation layer for insulating the compressed conductor, and a sheath layer formed outside of the insulation layer to protect the internal configuration, wherein the copper clad aluminum wire includes an inner part made of aluminum or an aluminum alloy and an outer part made of copper occupying 30 to 39% of a volume of the copper clad aluminum wire, wherein the compressed conductor comprises a plurality of copper clad aluminum wires stranded to form a layer in a radius direction, wherein the compressed conductor has an outer diameter that is 1.09 to 1.12 times larger than an outer diameter of a conductor including a same number of copper wires as the cooper clad aluminum wires.

7. The cable according to claim 6, wherein copper clad aluminum wires in an outermost layer of the compressed conductor have smaller gaps therebetween than copper clad aluminum wires in a central layer thereof.

8. A cable comprising:

a compressed conductor including at least one copper clad aluminum wire and having an outer diameter reduced by compression, an insulation layer for insulating the compressed conductor, and a sheath layer formed outside of the insulation layer to protect the internal configuration, wherein the copper clad aluminum wire includes an inner part made of aluminum or an aluminum alloy and an outer part made of copper occupying 30 to 39% of a volume of the copper clad aluminum wire, wherein copper clad aluminum wires in an outermost layer configuring the compressed conductor or copper clad aluminum wires in the outermost layer and in an inner layer adjacent to the outermost layer have outer appearances different from copper clad aluminum wires in a central layer of the compressed conductor, wherein the compressed conductor has an outer diameter that is 1.09 to 1.12 times larger than an outer diameter of a conductor including a same number of copper wires as the cooper clad aluminum wires.

* * * * *